US005690791A

United States Patent [19]

Vallius

[11] Patent Number: 5,690,791

[45] Date of Patent: *Nov. 25, 1997

[54] PRESS SECTION WITH AN EQUALIZING NIP IN A PAPER MACHINE

[75] Inventor: Oiva Vallius, Jyväskylä, Finland

[73] Assignee: Valmet Corporation, Helsinki, Finland

[ * ] Notice: The term of this patent shall not extend beyond the expiration date of Pat. No. 5,662,778.

[21] Appl. No.: 594,923

[22] Filed: Jan. 31, 1996

[30] Foreign Application Priority Data

Feb. 2, 1995 [FI] Finland ..... 950451

[51] Int. Cl.[6] ..... D21F 3/04

[52] U.S. Cl. ..... 162/205; 162/358.3; 162/360.3; 162/359.1

[58] Field of Search ..... 162/205, 358.3, 162/360.3, 359.1, 361

[56] References Cited

U.S. PATENT DOCUMENTS

| | | | |
|---|---|---|---|
| 4,566,946 | 1/1986 | Koponen et al. | 162/359 |
| 4,943,351 | 7/1990 | Wedel | 162/306 |
| 5,389,205 | 2/1995 | Pajula et al. | 162/205 |
| 5,545,295 | 8/1996 | Fujita et al. | 162/358.1 |

FOREIGN PATENT DOCUMENTS

| | | |
|---|---|---|
| 2113848 | 7/1994 | Canada . |
| 2126617 | 12/1994 | Canada . |
| 0608533 | 8/1994 | European Pat. Off. . |
| 9206340 | 9/1992 | Germany . |
| 4321406 | 11/1993 | Germany . |
| 4321405 | 8/1994 | Germany . |

*Primary Examiner*—Karen M. Hastings

*Attorney, Agent, or Firm*—Steinberg, Raskin & Davidson, P.C.

[57] ABSTRACT

A press section of a paper machine through which a paper web has a substantially closed and supported draw including an extended-nip zone and an equalizing-nip zone following the extended-nip zone in the running direction of the web. In the equalizing-nip zone, the asymmetry of roughness is equalized that was formed in the web to be pressed in the preceding press nip or nips, while not dewatering the web to a substantial extent. The extended-nip zone and the equalizing-nip zone are formed between three press components which are interconnected in a compact way so that the extended nip is formed by a press component provided with a flexible mantle together with a press roll provided with a rigid mantle. The press roll with the rigid mantle also forms the equalizing-nip zone together with a smooth-faced equalizing-press roll. After the equalizing-nip zone, the web has at least one free draw or runs on a transfer fabric, on which draw(s) or run, by a difference in speed, the stretch of the web in the machine direction, taking place in the equalizing-press nip is compensated for and the web is kept appropriately tensioned.

19 Claims, 4 Drawing Sheets

PRESS SECTION WITH AN EQUALIZING NIP IN A PAPER MACHINE

FIELD OF THE INVENTION

The present invention relates to a press section of a paper machine, through which the paper web has a substantially closed and supported draw and which press section comprises an extended-nip zone followed by an equalizing-nip zone in the running direction of the web. In the equalizing-nip zone, the asymmetry of roughness, that was formed in the web to be pressed in the preceding press nip or nips, is equalized while dewatering of the web does not occur, at least not to a substantial extent.

BACKGROUND OF THE INVENTION

One of the most important quality requirements of paper and board is uniformity of the structure both on the micro scale and on the macro scale. The structure of paper, in particular of printing paper, must also be symmetric. The good printing properties required from printing paper mean equal good smoothness, evenness, and certain absorption properties of both faces of the paper. The properties of paper, such as the symmetry of surface roughness and density, are affected to a considerable extent by the operation of the press section of the paper machine, which operation also has a decisive significance on the uniformity of the profiles of the paper in the cross direction and in the machine direction.

Increased running speeds of paper machines create new problems to be solved, which problems are mostly related to the runnability of the machine. Currently, running speeds of up to about 1500 meters per minute are employed. At these running speeds, so-called closed press sections, which comprise a compact combination of press rolls fitted around a smooth-faced center roll, usually operate satisfactorily. As examples of such press sections should be mentioned the current assignee's "Sym-Press II"™ and "Sym-Press O"™ press sections.

From the point of view of energy economy, dewatering taking place by pressing is preferable to dewatering taking place by evaporation. For this reason, attempts should be made to remove a maximum amount of water out of the paper web by pressing in order that the proportion of water to be removed by evaporation can be made as small as possible. Increased running speeds of paper machines, however, create new, so far unsolved problems expressly for the dewatering taking place by pressing, because the press impulse cannot be increased sufficiently by the means known from the prior art. This inability to increase the press impulse results from the fact that at high speeds, the nip times in roll nips remain inadequately short and, on the other hand, the peak pressure of pressing cannot be increased beyond a certain limit without destruction of the structure of the web.

In the prior art press sections, the single-felt last press nip tends to produce a poor symmetry of roughness, in particular with fine paper and with LWC and MWC base paper. The problem is emphasized when the press impulse is high, as is the case with an extended-nip press in the last press position. For example, with MWC base paper, with the assignee's test paper machine, when non-calendered, for top-face/bottom-face Bendtsen roughness the value of 0.52 was obtained, when the press load was about 800 kN per meter in a "Sym-Belt S"™ press section, when the length of the press shoe was about 152 mm, and when the smooth press roll was in the upper position of the single-felt press nip. This high asymmetry of roughness constitutes a limitation for the extent of press load, for the dry solids content that can be achieved, and for the wet strength.

It is known in the prior art to employ so-called equalizing presses in connection with various press sections, including extended-nip press sections, by means of which attempts are made to equalize the above asymmetry of roughness. With respect to these prior art equalizing presses, reference is made, for example, to the assignee's Finnish Patent No. 64,823 (which corresponds to U.S. Pat. No. 4,566,946, the specification of which is incorporated by reference herein), to published German Patent Application No. 4,321,406 A1 of Messrs. J. M Voith GmbH, and to German Utility Model No. G 9,206,340.3 of Messrs. Sulzer-Escher Wyss GmbH. By means of the equalizing presses known from these publications mentioned above, it has, however, not been possible to solve the problems related to asymmetry of roughness in a satisfactory manner, in particular not in connection with a supported transfer of the web.

Of the cited publications mentioned above, the German Utility Model is likely the most closely related to the present invention, and in the equalizing press described in this Utility Model, the lower press roll in the equalizing press curves the transfer belt and the web over a considerably large angle. Moreover, in connection with the same lower press roll, a web transfer nip has been formed by means of a suction roll. Thus, in this construction, it is impossible to make use of differences in speed, by whose means it would be possible to tighten the web after the equalizing press so as to eliminate the effects of elongation of the web taking place in the equalizing press. Moreover, in these constructions, there is a relatively abrupt angle of change in direction in a sensitive area directly after the equalizing press which, for its pad, restricts the speed of operation of the press.

Moreover, the prior art press sections provided with an equalizing press in a paper machine have occupied quite a large space, in particular in the machine direction, and in the prior art constructions, it has not been possible to utilize the various components in an optimal manner.

OBJECTS AND SUMMARY OF THE INVENTION

Accordingly, it is an object of the present invention to avoid these drawbacks of prior art press constructions.

It is another object of the invention to further develop the prior art most closely related to the present invention, i.e., a press section including an equalizing nip.

It is still another object of the invention to provide a new and improved press section with an equalizing nip in a paper machine.

In view of achieving the objects stated above and others, in the press section in accordance with the invention, an extended-nip zone and an equalizing-nip zone are formed between three press components which are interconnected in a compact way so that the extended nip is formed by a press component that is provided with a flexible mantle together with a press roll provided with a rigid mantle which also partially defines the equalizing-nip zone, together with a smooth-faced equalizing-press roll. After the equalizing-nip zone, the web has a free draw or free draws or the run of a transfer fabric, on which draw/draws or run, by means of a difference in speed, the stretch of the web in the machine direction, taking place in the equalizing-press nip, can be compensated for and the web can be kept appropriately tensioned. The difference is speed is realized between the web travel speed after the equalizing-nip zone and the web travel speed before the equalizing-nip zone.

In the press section of the present invention, an extended-nip press is used, in which one of the press components is, for example, a hose roll with a resilient mantle, and the other press component defining the extended-nip press is a rigid-mantle press roll, the equalizing nip being formed against the rigid-mantle press roll. Thus, the press roll of the extended-nip press operates, at the same time, in two different functions, i.e., as a press component both in the extended nip and in the equalizing nip, which makes the construction highly favorable and compact. Thus, in the press section in accordance with the invention, advantages are realized in that the press section can be made smaller and with fewer components than conventional press sections with an equalizing press nip.

Furthermore, owing to the equalizing nip arranged in accordance with the invention, both sides of the web am provided with smoothness properties of substantially the same level, i.e., the symmetry of roughness discussed above is carried into effect. Thus, the achievement of a symmetry of roughness does not constitute a limitation for the extents of press loads, for the dry solids content that can be achieved, or for the wet strength, which was the case in similar prior art press sections.

In the invention, it has been possible to create such a press section including an equalizing nip which is very compact in particular in the machine direction, so that if necessary, for example in the case of modernizations of paper machines, it can be arranged in the place of an existing compact press section.

In one preferred embodiment of the invention, the web is transferred from the last dewatering extended nip in the press section on a transfer belt as a linear run through the equalizing press so that the joint run of the transfer belt and the web after the equalizing nip continues as a substantially straight run. On the open draw or draws of the web after the equalizing nip or on the run of the transfer belt and the web, the web and the transfer fabric can be stretched to some extent so that the elongation of the web inevitably taking place in the equalizing press can be compensated for and the web be kept appropriately tight.

In other embodiments of the invention, it is possible to employ a particular transfer belt which transfers the paper web from the equalizing-nip zone to the dryer section of the paper machine. In such embodiments, the transfer belt is preferably arranged so that the equalizing-press roll is placed inside the loop of the transfer belt. The outer face of this transfer-belt loop has suitable properties of smoothness and adhesion, and its elastic properties am suitable for the purpose, so that, when the difference in speed is utilized in accordance with the invention, elongation of the web taking place in the equalizing-press nip in the machine direction can be compensated for and the web can be kept appropriately tight.

Thus, in its most basic embodiment, the press section of a paper machine in which a paper web is pressed, comprises first and second press rolls arranged in nip-defining relationship to form an extended nip through which the web passes. The first press roll has a flexible mantle and the second press roll has a rigid mantle. A third press roll is arranged in nip-defining relationship with the second press roll to form an equalizing-nip zone through which the web passes after the extended-nip zone. The third press roll comprises a smooth-faced equalizing-press roll. As discussed above, the web is stretched in the equalizing-nip zone to equalize asymmetry of roughness formed in the web at least in the extended-nip zone before the equalizing-nip zone as well as in the preceding nips. The press section also includes compensation means arranged after the equalizing-nip zone for changing the speed of the web such that the web has a different running speed after the equalizing-nip zone than before the equalizing-nip zone to compensate for stretching of the web taking place in the equalizing-press nip and to tension the web. The compensation means may comprise means for providing the web with at least one free draw immediately after the equalizing-nip zone or means for carrying the web on a transfer fabric immediately after the equalizing-nip zone.

The present invention also relates to a method for pressing a web in a press section of a paper machine which comprises the steps of forming an extended nip between first and second press rolls, the first press roll having a flexible mantle and the second press roll having a rigid mantle, passing the web through the extended nip forming an equalizing-nip zone between a third press roll and the second press roll, the third press roll comprising a smooth-faced equalizing-press roll, passing the web through the equalizing-nip zone after the extended-nip zone to stretch the web in order to equalize asymmetry of roughness formed in the web at least in the extended-nip zone before the equalizing-nip zone, and changing the speed of the web such that the web has a different running speed after the equalizing-nip zone than before the equalizing-nip zone to compensate for the stretching of the web taking place in the equalizing-press nip and to tension the web. The method may include the steps of providing the web with a single free draw immediately after the equalizing-nip zone or providing the web with at least two free draws immediately after the equalizing-nip zone or carrying the web on a transfer fabric immediately after the equalizing-nip zone.

In the following, the invention will be described in detail with reference to some exemplifying embodiments of the invention illustrated in the figures in the accompanying drawing. However, the invention is by no means strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
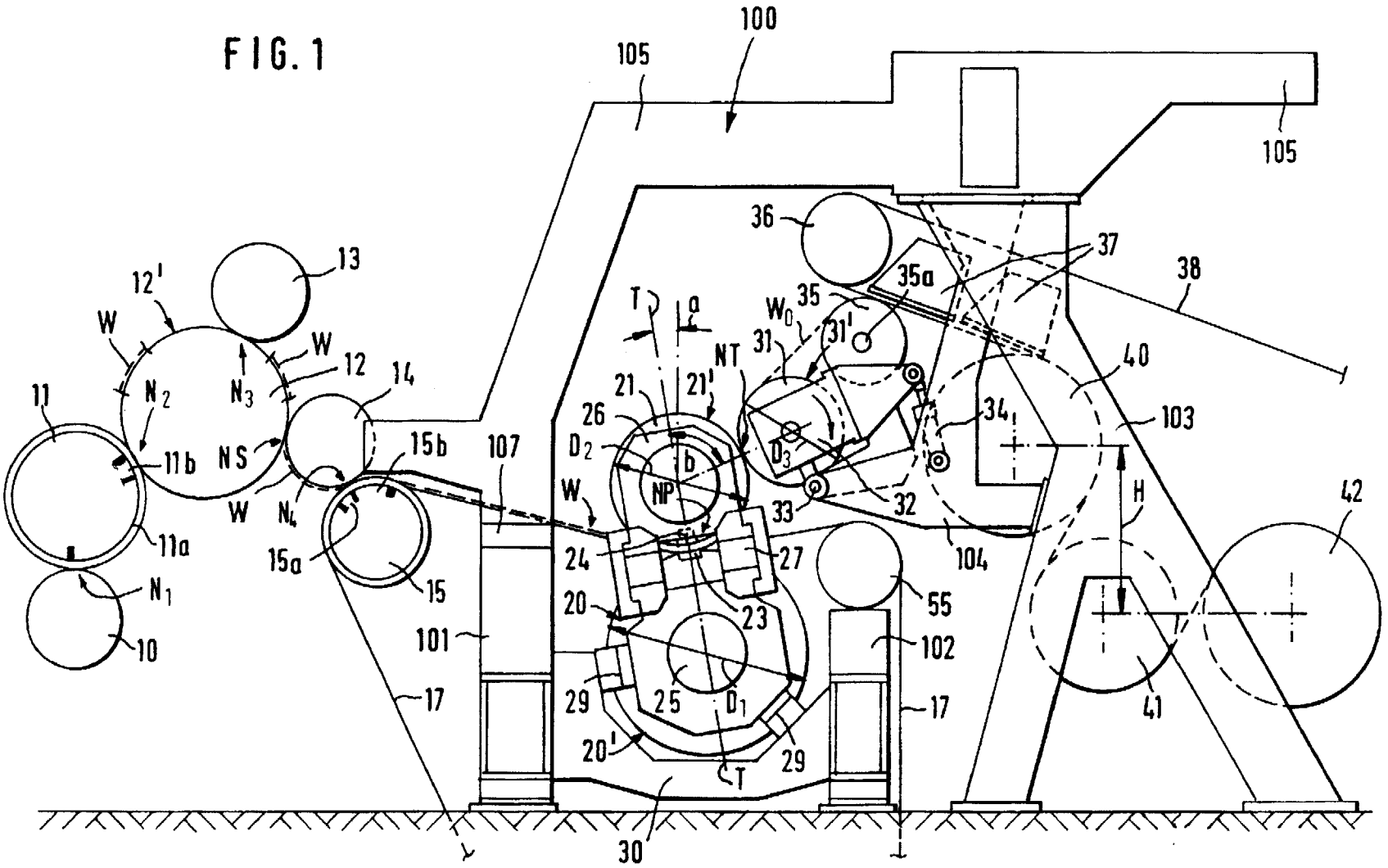
FIG. 1 is a schematic side view of an embodiment of the invention in which there is first a dosed press portion of the "Sym-Press II"™ type, which is followed by a compact press portion in accordance with the invention, comprising an extended nip and an equalizing nip.

Referring to the accompanying drawings wherein the same reference numerals refer to the same or similar elements, as shown in FIG. 1, after the web former of forming section in the paper machine, the press section in the paper machine comprises a compact combination of press members such as press rolls 10,11,12 and 13, which rolls form three dewatering press nips $N_1$, $N_2$ and $N_3$ with each other, i.e., rolls 10 and 11, rolls 11 and 12, and rolls 12 and 13 are in nip-defining relationship with one another. Roll 12 is termed a "center roll" in view of its central location and properties with respect to the other rolls. The first nip $N_1$ in the running direction of the web is provided with two felts. After the nip $N_1$, the web W is transferred on a pick-up felt (not shown) through suction zones 11*a* and 11*b* into the second nip $N_2$, after which the web follows the smooth face 12' of the center roll 12 of the press into the third nip $N_3$ which is formed between the press rolls 12 and 13. After the nip $N_3$, the web W is separated from the center roll 12 by means of another press roll 14 which is arranged with respect to the center roll 12 to form a low-load transfer nip Ns with the center roll 12. By means of the roll 14, the web W is transferred onto the lower fabric 17 in the area of suction zones 15*a* and 15*b* of a transfer-suction roll 15 in nip-defining relationship with the roll 14. The rolls 14 and 15 form either a press nip $N_4$ or a corresponding low-load transfer nip with one another. In FIG. 1, the rolls 10,11,12 and 13 form a press section of the so-called "Sym-Press II"™ type. Instead of this, it is also possible to use the assignee's press section of the "Sym-Press O"™ type or one or several separate roll nip(s) and/or extended nip(s). After the transfer suction roll 15, the web W is transferred on the top face of the press fabric 17 through an extended-nip zone NP in the press section in accordance with the invention.

The extended-nip zone NP shown in FIGS. 1–5 is accomplished, for example, by means of the assignee's "Sym Belt Press"™, the details of whose construction are illustrated, e.g., in FIG. 10 in the assignee's Finnish Patent Application No. 905798, corresponding to the current assignee's U.S. Pat. No. 5,389,205, the specification of which is incorporated by reference herein. With regard to its principal features, the construction of the press is such that the extended nip NP is composed of a flexible hose mantle 20' and a rigid backup roll 21. The hose mantle 20', which is placed inside the loop of dewatering fabric 17,53, is preferably hollow-faced. Inside the hose mantle 20', there is a hydrostatically and/or hydrodynamically lubricated glide shoe 23, and the hydraulic loading means placed in connection with the shoe press the glide shoe 23 against the rigid backup roll 21. The backup roll 21 is a press roll, for example the assignee's adjustable-crown "Sym-Z Roll"™, which has a smooth or hollow-faced cylindrical mantle 21'.

As shown in FIG. 1 herein, the flexible-mantle 20' hose roll 20 or equivalent is placed as the lower roll, and the upper roll is a rigid roll 21 which is expressly provided with a smooth face 21'. After the extended-nip zone NP, the upper press roll 21 forms an equalizing nip NT together with a smooth-faced 31' equalizing-press roll 31. The roll 31 is provided with a drive 31*a* of its own. The equalizing-press roll 31 is mounted on the bearing supports 32 which are connected with the frame part 104 by means of horizontal articulation shafts 33. The bearing supports 32 are connected with actuators 34 by whose means it is possible to produce a compression pressure in the equalizing nip NT and, when necessary, to open the nip, for example, in connection with threading of the web W. After the equalizing nip NT, the web W follows the smooth face 31' of the roll 31. After this, there is a free draw $W_0$ of the web on which the web W can be kept tight so as to compensate for elongation of the web taking place in the equalizing nip NT. This is accomplished, e.g., by varying the rotational speed of the rolls defining the free, open draw $W_0$ to provide a speed difference between the speed of the web as it runs over the two rolls.

Figure 2:
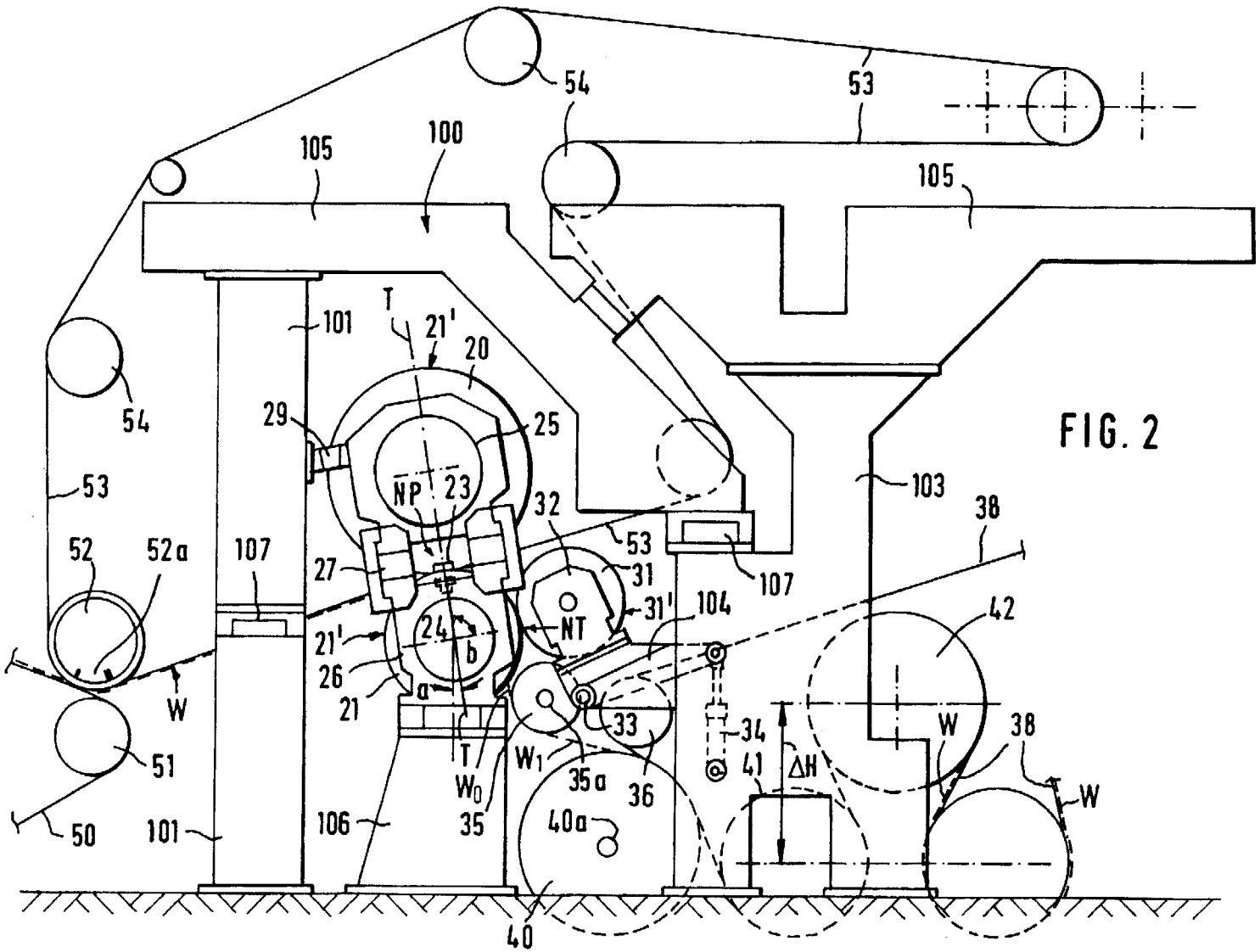
FIG. 2 is an illustration similar to FIG. 1 of an embodiment of the invention in which the paper web to be pressed is brought straight from the forming wire on an upper pick-up press fabric into the extended nip in the press section in accordance with the invention.
Figure 3:
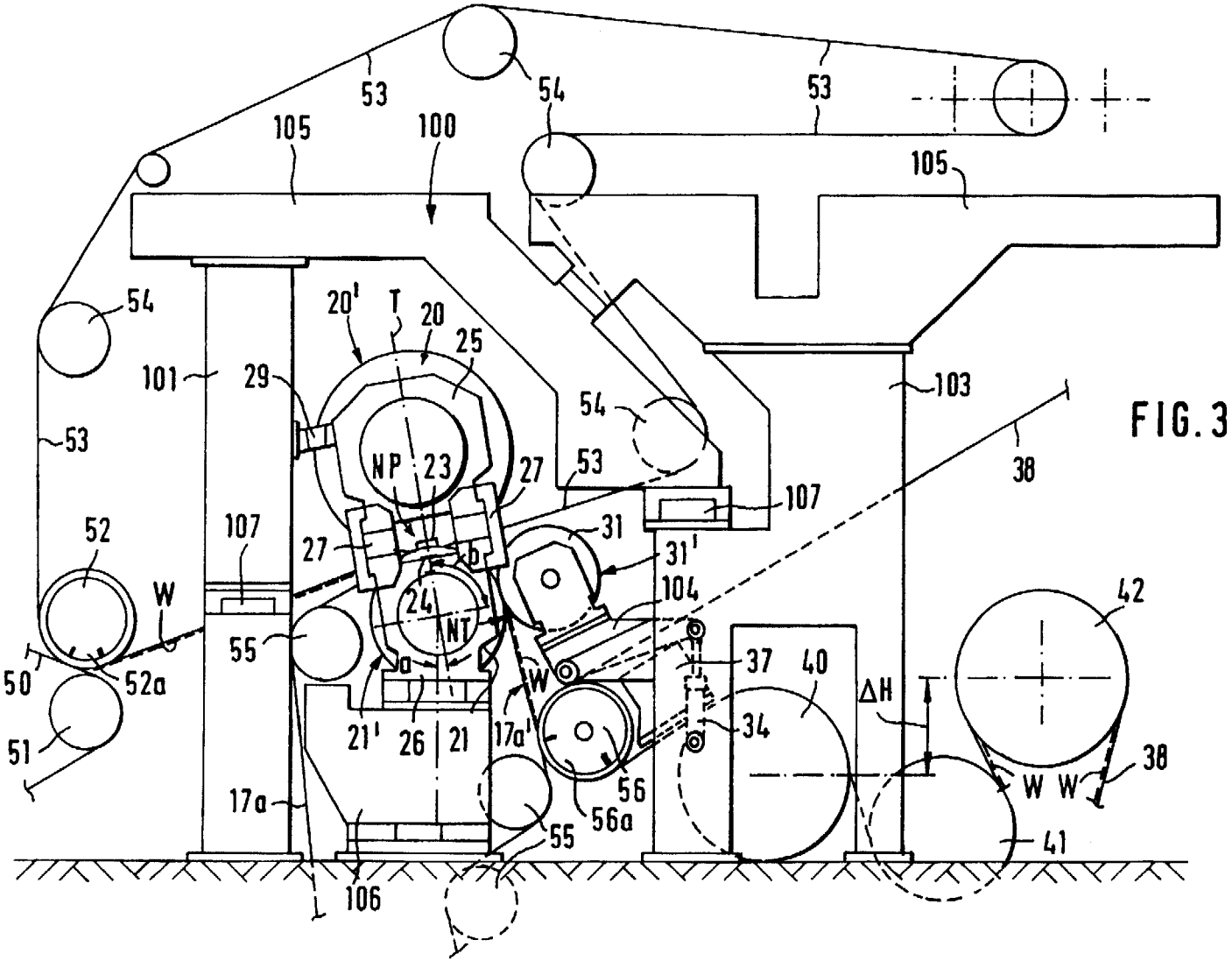
FIG. 3 shows a modification of the press section shown in FIG. 2 in which two opposite fabrics have been passed through the extended-nip zone.

In the embodiment shown in FIG. 2, the rigid roll 21 has a smooth cylinder mantle 21', whereas in the embodiment shown in FIG. 3 the mantle 21' of the rigid roll 21 can be smooth or hollow-faced. After a paper guide roll 35, the web W is transferred into the dryer section of the paper machine onto the lower face of a drying wire 38 after its guide roll 36, to which wire the web is made to adhere by means of transfer-suction boxes 37. The transfer-suction boxes 37 are followed in the web travel direction by a first drying cylinder 40 or by a corresponding lead-in cylinder of the dryer section, which is placed in a position higher than the other drying cylinders in the first group with single-wire draw in the dryer section. The drying cylinder 40 or equivalent is followed by a reversing suction roll 41 and, after that, by a contact-drying cylinder 42, which is placed in a "normal" height position in the first group with single-wire draw.

The press section shown in FIGS. 2 and 3 differs from that shown in FIG. 1, in the respect that the press section does not include an initial press portion of the "Sym-Press II"™ type, but the paper web W is separated from a forming wire 50 before its drive roll 51 on a suction zone 52*a* of a pick-up roll 52 and is transferred on the lower face of a pick-up fabric 53 through the extended-nip zone NP. After the extended-nip zone NP, the paper web W is separated from the pick-up fabric 53, which operates as the upper water-receiving press fabric in the extended nip NP. The pick-up fabric 53 is guided by guide rolls 54. Furthermore, the extended-nip zone NP shown in FIGS. 2 and 3 differs from that shown in FIG. 1 in the respect that, in FIGS. 2 and 3, the flexible-mantle 21' hose roll 20 is placed as the upper press component, and the lower press component is a rigid-mantle press roll 21, in whose interior there is a series 24 of glide shoes for crown regulation.

In FIG. 2, after the extended-nip zone NP, the web W follows the smooth face 21' of the press roll 21 into the equalizing nip NT, which is formed by the press roll 21 and by the equalizing-press roll 31 which has a smooth cylinder face 31'. After the equalizing nip NT, the web W continues to follow the smooth face 21' of the press roll 21, from which it is separated as a free draw $W_0$ by means of a driven 35*a* paper guide roll 35 while making use of a suitable difference in speed and of tension. The drive means 35*a* of the paper guide 35 are controlled to provide a difference in speed of the web, i.e., the web will travel at a different speed over the paper guide roll 35 and over the equalizing-press roll 31. The roll 31 in the equalizing nip NT is mounted on bearing supports 32, which are again attached to a projection part 104 of a frame 103 by means of horizontal articulation shafts 33. The equalizing nip NT can be loaded and opened by means of actuators 34 which are coupled between the bearing support 32 and the frame 103. The paper guide roll 35 is followed by a second free draw $W_1$ of the web W, by whose means the web W can be tensioned further by means of the first drying cylinder 40 or the corresponding lead-in cylinder while making use of the drive 40*a* of the drying cylinder 40. After this, the web W is transferred on the cylinder 40 to a position underneath the drying wire 38 and further onto a reversing suction cylinder 41 and onto a contact-drying cylinder 42. In the embodiments in FIGS. 1 and 2, the paper guide roll 35 is arranged between the equalizing nip and the initial drying cylinder in the dryer section and between the equalizing nip and the initial drying wire guide roll over which the drying wire runs, i.e., the web runs into contact with the paper guide roll 35 before it engages the initial drying wire and the initial drying cylinder.

Differing from FIG. 2, in FIG. 3 the extended-nip zone NP is provided with a lower fabric 17*a* which runs through the extended-nip zone NP and the equalizing nip NT while guided by guide rolls 55. The fabric 17*a* is preferably a transfer belt which substantially does not receive water. The web W follows the belt after the equalizing nip NT on its run 17*a'*, on which run it is possible to employ a difference in speed that stretches the transfer belt 17*a*. In this manner, it is possible to compensate for elongation of the web W taking place in the equalizing nip NT in the machine direction, in a way similar to what takes place on the free draw $W_0$ in FIG. 1 or on the free draws $W_0$ and $W_1$ in FIG. 2. After the substantially vertical downward draw 17*a'* of the transfer belt 17*a*, the web W is transferred onto the drying wire 38 by the effect of the suction zone 56*a* of the transfer-suction roll 56, and further onto the first drying cylinder or a corresponding lead-in cylinder, which is placed in a position lower than the contact-drying cylinders 42 in the first group with single-wire draw. In the other respects, the construction shown in FIG. 3 is similar to the construction shown in FIG. 2 and described above.

Figure 4:
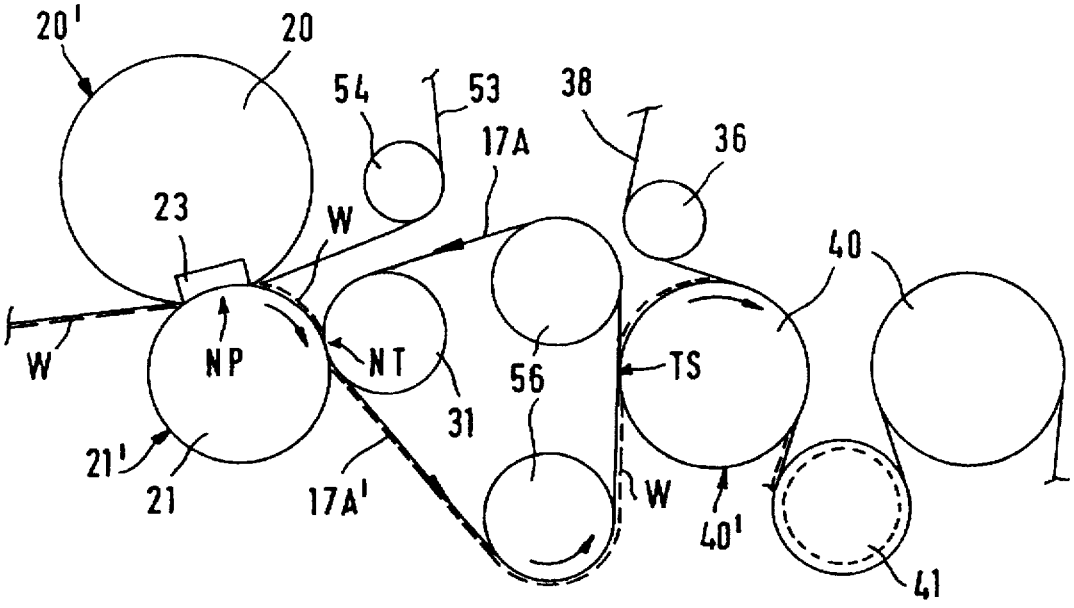
FIG. 4 is a schematic illustration of a modification of the press sections shown in FIGS. 2 and 3 in which the web is transferred from the equalizing-nip zone to the dryer section by means of a particular transfer-belt loop.
Figure 5:
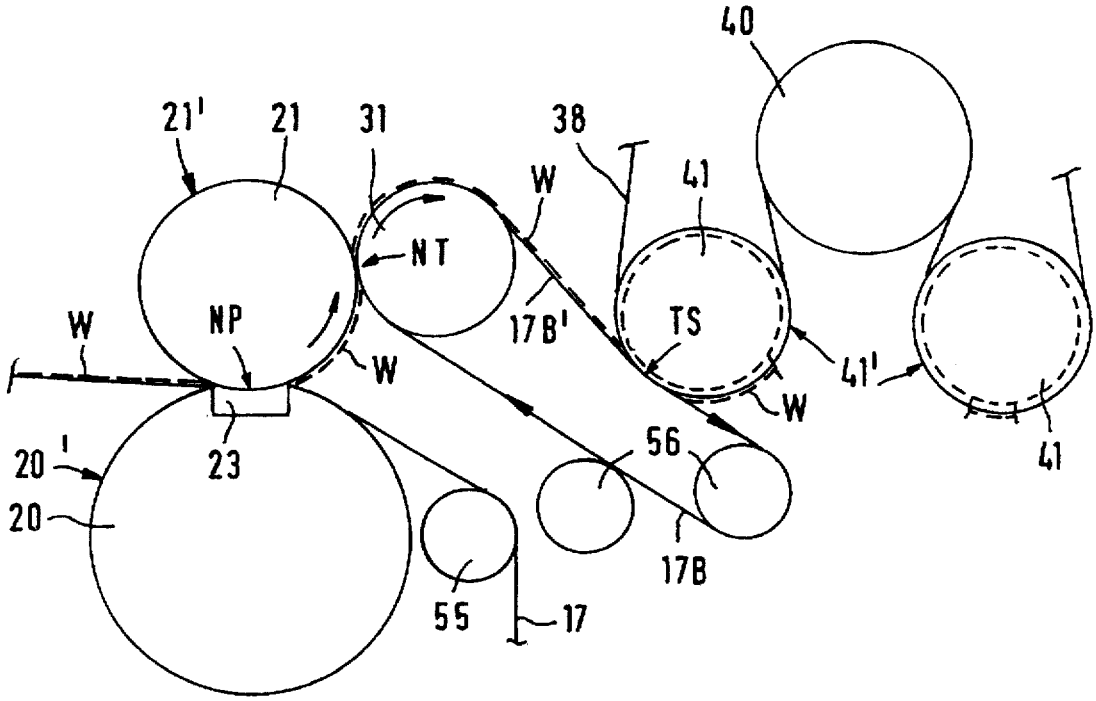
FIG. 5 is a schematic illustration of a modification of the press shown in FIG. 1, in which the web is transferred from the equalizing-nip zone to the dryer section using a particular transfer-belt loop.

FIGS. 4 and 5 are illustrations more schematic than FIGS. 1, 2 and 3 of two lo embodiments of the invention, in which a particular loop of a transfer belt 17A, 17B is used for transferring the web W from the equalizing-nip zone NT to the dryer section. FIG. 4 is mainly similar to the embodiments shown in FIGS. 2 and 3 in the respect that the hose roll 20 is placed above in the extended nip NP. According to FIG. 4, after the extended nip NP, the web W is transferred on the smooth face 21' of the press roll 21 to the equalizing-nip zone NT, through which a particular loop of transfer belt 17A runs, which belt loop is guided by guide rolls 56. The latter press roll 31 in the equalizing-nip zone NT is placed inside the transfer-belt loop 17A. After the equalizing nip NT, the web W is transferred further on the downwardly inclined straight run 17A' of the transfer belt 17A, on which run, while making use of a difference in speed, it is possible to compensate for elongation of the web W taking place in the equalizing nip NT in the machine direction and to keep the web W appropriately tight. After the run 17A', the web W is transferred by means of the loop of transfer belt 17A over the guide roll 56 to the transfer zone TS, where the web W is transferred onto the smooth face 40' of the drying cylinder 40.

FIG. 5 is substantially similar to the embodiment shown in FIG. 1, in which the hose roll 20 is placed below the rigid press roll 21. After the extended nip NP, the web W follows the smooth face 21' of the press roll 21 into the equalizing nip NT, through which a particular loop of transfer belt 17B runs. After the equalizing nip NT, the web W is transferred on the transfer belt 17B over the press roll 31 onto the downwardly inclined run 17B' of the loop of transfer belt 17B, on which run, while making use of a difference in speed, it is possible to compensate for elongation of the web W taking place in the equalizing-press nip NT in the machine direction and to keep the web W appropriately tight. After the run 17B', the web W is transferred in the transfer zone TS onto the drying wire 38, which runs over the turning sector of the reversing-suction cylinder 41, which turning sector is provided with a hollow face 41' subjected to a vacuum. The outer faces of the particular transfer belts 17A, 17B employed in FIGS. 4 and 5 have smoothness and adhesion properties suitable in view of the operation of the equalizing nip NT and in view of transfer of the web W further. The transfer belt 17A, 17B is also a belt which does not substantially receive water, and it has elastic properties suitable for the purposes stated above.

The press section in accordance with the invention is usable even at very high web speeds. According to a preliminary estimate, an embodiment as shown in FIGS. 1 and 2, in which there is/are an open draw $W_0$ or draws $W_0$, $W_1$ of the web W, can be used up to a running speed of about 1700 meters per minute. For running speeds higher than this, the fully closed draws of the web W through the press section and further to the dryer section, as shown in FIGS. 3, 4 and 5, are available.

FIGS. 1, 2 and 3 are also schematic illustrations of the frame construction 100 of the press section, which comprises vertical frames 101, 102 and 103 and a connecting upper horizontal frame 105.

As shown in FIG. 1, the hose roll 20 of the extended nip NP is supported by means of its bearing supports 25, intermediate parts 29, and the lower frame 30 between the vertical frames 101 and 102. The bearing supports 26 of the upper press roll 21 are connected by means of intermediate parts 27 to the bearing supports 25 of the hose roll 20 to receive the high loading forces at the extended nip NP, which loading forces are produced by means of series of press shoes 23 and 24. In the embodiments shown in FIGS. 2 and 3, the upper hose roll 20 is coupled by means of its bearing supports 25 and the intermediate parts 29 with the top portion of the vertical frame 101, and similarly the bearing supports 26 of the lower press roll 21 are supported on the lower base part 106. In the other respects, the frame constructions are in themselves known from the prior art and provided with openable intermediate pieces 107 necessary, for example, for replacement of the press fabrics 17; 17*a*, 53,53.

Attempts have been made to optimize the geometry of the compact combination of rolls comprising the extended nip NP and the equalizing nip NT both in respect of utilization of space and in respect of undisturbed draw of the web W also at high web speeds (about 1500 to about 2000 meters per minute). For these purposes, it is preferable that the press plane T—T passing through the extended nip NP is inclined at a small angle a in relation to the direction of arrival of the web W. The magnitude of the angle of inclination a is generally from about 10° to about 15°, preferably 10°. In FIG. 1, the equalizing nip NT is preferably placed on the latter upper quarter of the press roll 21 at a distance of the center angle b from the plane T—T. The angle b is generally selected in the range of from about 70° to about 80°, preferably about 75°.

In the press section geometry as shown in FIG. 1, it is preferable that, when the equalizing nip NT is placed above the extended nip NP, in which case the substantial or principal direction of the run of the web after the extended nip NP is upwardly inclined, the first drying cylinder 40 or the corresponding lead-in cylinder is placed at a position higher than the normal position, or the substantial or principal direction of the first single-wire draw is arranged downwardly inclined in the running direction of the web. The situation is contrary in the embodiments shown in FIGS. 2 and 3, in which the equalizing nip NT is placed below the extended nip NP, in which case the substantial direction of the web after the extended nip NP towards the dryer section is downwardly inclined, in which case the first drying cylinder 40 or the last lead-in cylinder is arranged at a level lower than the normal position (the dimension ΔH indicated in FIGS. 2 and 3).

The diameter D1 of the flexible-mantle 20' hose roll 20 or equivalent at the extended-nip zone has been chosen in the range of from about 1400 mm to about 2000 mm, depending on the width of the machine. The diameter D2 of the rigid-mantle 21' press roll 21 at the extended-nip zone NP has been chosen in the range from about 1200 mm to about 1600 mm, depending on the width of the machine. The diameter D3 of the smooth-faced 31' press roll 31 at the equalizing nip NT has been chosen in the range of from about 700 mm to about 1200 mm, depending on the width of the machine.

The examples provided above are not meant to be exclusive. Many other variations of the present invention would be obvious to those skilled in the art, and are contemplated to be within the scope of the appended claims.

I claim:

1. In a paper machine having a forming section in which a paper web is formed, a press section in which the web is pressed and a dryer section in which the web is dried, the dryer section including a drying wire for carrying the web, an initial drying cylinder over which the web first runs in the dryer section and an initial drying wire guide roll over which the drying wire runs before carrying the web thereon, the press section comprising:

first and second press rolls arranged in nip-defining relationship to form an extended nip, said first press roll having a flexible mantle, said second press roll having a rigid mantle, a press felt or fabric for carrying the web through said extended nip whereby the web is dewatered in said extended nip, a third press roll arranged in nip-defining relationship with said second press roll to form an equalizing nip through which the web passes after said extended nip, said third press roll comprising a smooth-faced equalizing-press roll structured and arranged to directly contact the web, the web being stretched in said equalizing nip to equalize asymmetry of roughness formed in the web at least in said extended nip before said equalizing nip, and compensation means arranged after said equalizing nip for compensating for stretching of the web taking place in said equalizing nip and for tensioning the web, said compensation means comprising a guide roll arranged between said equalizing-press roll and the initial drying cylinder and between said equalizing-press roll and the initial drying wire guide roll in the running direction of the web and such that the web has an open draw from said equalizing-press roll to said guide roll, and drive means for rotating said guide roll such that the web has a different running speed about said guide roll than in said equalizing nip.

2. The paper machine of claim 1, wherein the drying cylinder is arranged relative to said guide roll such that the web has a free draw from said guide roll to the initial drying cylinder.

3. The paper machine of claim 1, wherein the press section further comprises a plurality of rolls defining at least one roll nip arranged before said extended nip in the web running direction.

4. The paper machine of claim 1, wherein the web is carried on a forming wire in the forming section, the press section further comprising a pick-up fabric for receiving the web from the forming wire in a pick-up zone, the web being carried on a lower face of said pick-up fabric into said extended nip such that said pick-up fabric operates as an upper water-receiving press fabric in said extended nip, the web being separated from said pick-up fabric after said extended nip.

5. The paper machine of claim 4, wherein said first press roll is arranged above said second press roll in said extended nip, said first press roll constituting a hose roll having a flexible, hollow-faced mantle and internal loading means for loading said flexible, hollow-faced mantle, said second press roll comprising hydraulic crown regulation means arranged inside said rigid mantle.

6. The paper machine of claim 4, wherein said first press roll is arranged above said second press roll in said extended nip, said second press roll having a smooth cylinder face, the web being carried on said smooth cylinder face of said second press roll into and through said equalizing nip, said guide roll being arranged proximate said second press roll for separating the web from said smooth cylinder face of said second press roll.

7. The paper machine of claim 1, wherein said second press roll is arranged above said first press roll such that said equalizing nip is situated above said extended nip, the web being passed on an upper face of a lower press fabric through said extended nip.

8. The paper machine of claim 7, wherein the initial drying cylinder is arranged at a position higher than a remainder of drying cylinders in the dryer section.

9. The paper machine of claim 1, wherein said equalizing nip is situated at a height position lower than said extended nip, the initial drying cylinder being arranged at a position lower than a remainder of drying cylinders in the dryer section.

10. The paper machine of claim 1, wherein a press plane defined by the center axis of said first roll and the center axis of said second press roll is inclined at an angle in relation to a direction of arrival of the web into said extended nip, said angle being from about 10° to about 15°.

11. The paper machine of claim 1, wherein a common sector of contact of the web and said rigid mantle of said second press roll in said extended nip is from about 80° to about 100°.

12. The paper machine of claim 1, wherein the diameter of said first press roll is from about 1400 mm to about 2000 mm, the diameter of said second press roll is from about 1200 mm to about 1600 mm, and the diameter of said third press roll is from about 700 mm to about 1200 mm.

13. A method for pressing a web in a press section of a paper machine, comprising the steps of:

forming an extended nip between first and second press rolls, said first press roll having a flexible mantle, said second press roll having a rigid mantle, passing the web on support of a press felt or fabric through said extended nip whereby the web is dewatered in said extended nip, forming an equalizing nip between a third press roll and said second press roll, said third press roll comprising a rotatable smooth-faced equalizing-press roll directly contacting the web, passing the web through said equalizing nip after said extended nip to stretch the web in order to equalize asymmetry of roughness formed in the web at least in said extended nip before said equalizing nip, arranging a rotatable guide roll between said equalizing-press roll and an initial drying cylinder of a dryer section arranged after the press section and between said equalizing-press roll and an initial drying wire guide roll over which a drying wire runs before carrying the web thereon such that the web has an open draw from said equalizing-press roll to said guide roll, and rotating said guide roll such that the web has a different running speed about said guide roll than in said equalizing nip to compensate for the stretching of the web taking place in said equalizing nip and to tension the web.

14. The method of claim 13, further comprising the step of:

providing the web with an open draw in from said guide roll to the initial drying cylinder in the dryer section.

15. The method of claim 13, further comprising the steps of:

arranging the initial drying cylinder in the dryer section at a position higher than a remainder of drying cylinders in the dryer section.

16. In a press section of a paper machine in which a paper web is pressed including extended-nip means for forming an extended nip, said extended-nip means comprising a first press roll having a flexible mantle and a second press roll having a rigid mantle arranged in nip-defining relationship with said first press roll, a press felt or fabric for carrying the web through said extended nip whereby the web is dewatered in said extended nip, the improvement comprising an equalizing nip arranged after said extended nip and defined in part by a third press roll, the web being passed through said equalizing nip after said extended nip, said third press roll comprising a smooth-faced equalizing-press roll structured and arranged to directly contact the web, the web being stretched in said equalizing nip to equalize asymmetry of roughness formed in the web in said extended nip, and compensation means arranged after said equalizing nip for compensating for stretching of the web taking place in said equalizing nip and to tension the web, said compensation means comprising a guide roll arranged to directly contact the web but not in nip-defining engagement with said second press roll and drive means for rotating said guide roll such that the web has a different running speed about said guide roll than in said equalizing nip.

17. The press section of claim 16, wherein said guide roll is arranged such that the web has an open draw from said equalizing nip to said guide roll.

18. In a press section of a paper machine in which a paper web is pressed including extended-nip means for forming an extended nip, said extended-nip means comprising a first press roll having a flexible mantle and a second press roll having a rigid mantle arranged in nip-defining relationship with said first press roll, a press felt or fabric for carrying the web through said extended nip whereby the web is dewatered in said extended nip, the improvement comprising a third press roll arranged in nip-defining relationship with said second press roll to form an equalizing nip through which the web passes after said extended nip, said third press roll comprising a smooth-faced equalizing-press roll structured and arranged to directly contact the web, the web being stretched in said equalizing-nip zone to equalize asymmetry of roughness formed in the web in said extended nip, a stretchable transfer belt running over said second press roll and through said extended nip, said transfer belt running through said equalizing nip and in a substantially straight run after said equalizing nip in which the web is carried forward, and compensation means for compensating for the elongation of the web in said equalizing nip by providing the web with a different running speed after the equalizing nip than before said equalizing nip, said compensation means comprising means for stretching said substantially straight run of said transfer belt.

19. In a paper machine having a forming section in which a paper web is formed, a press section in which the web is pressed and a dryer section in which the web is dried, the dryer section including an initial drying cylinder over which the web first runs in the dryer section, the press section including extended-nip means for forming an extended nip, said extended-nip means comprising a first press roll having a flexible mantle and a second press roll having a rigid mantle arranged in nip-defining relationship with said first press roll, a press felt or fabric for carrying the web through said extended nip whereby the web is dewatered in said extended nip, a method for pressing the web in the press section comprising the steps of;

passing the web through an equalizing nip after said extended nip to stretch the web and equalize asymmetry of roughness formed in the web in said extended nip, said equalizing nip being defined in part by a third press roll, transferring the web to a smooth-faced, stretchable transfer belt in said equalizing nip, said transfer belt running in a loop over said third press roll through said equalizing nip and in direct contact with the web, rotating a drive roll arranged in the loop of said transfer belt to stretch said transfer belt after said third press roll in order to compensate for the stretching of the web taking place in said equalizing nip and tension the web, said drive roll being rotated such that the web has a different running speed after said equalizing nip than before said equalizing nip, and then transferring the web from said transfer belt after the stretching of said transfer belt into direct contact with the initial drying cylinder in the dryer section of the paper machine.

* * * * *